US009989069B2

(12) United States Patent
Manabe

(10) Patent No.: US 9,989,069 B2
(45) Date of Patent: Jun. 5, 2018

(54) VACUUM PUMP AND MASS SPECTROMETER

(71) Applicant: Shimadzu Corporation, Kyoto (JP)

(72) Inventor: Masashi Manabe, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days. days.

(21) Appl. No.: 15/234,358

(22) Filed: Aug. 11, 2016

(65) Prior Publication Data

US 2017/0074283 A1 Mar. 16, 2017

(30) Foreign Application Priority Data

Sep. 15, 2015 (JP) ..... 2015-181787

(51) Int. Cl.

| | |
|---|---|
| ***F01D 19/02*** | (2006.01) |
| ***F04D 29/52*** | (2006.01) |
| ***F04D 19/04*** | (2006.01) |
| ***H01J 49/24*** | (2006.01) |
| ***H01J 49/26*** | (2006.01) |

(52) U.S. Cl.

CPC ..... *F04D 29/522* (2013.01); *F04D 19/042* (2013.01); *F04D 19/044* (2013.01); *H01J 49/24* (2013.01); *H01J 49/26* (2013.01); *F05B 2240/12* (2013.01); *F05B 2240/24* (2013.01); *F05B 2240/511* (2013.01); *F05B 2260/2241* (2013.01)

(58) Field of Classification Search

USPC ..... 250/281, 282, 283; 415/118, 221.2, 415/121.2, 200

See application file for complete search history.

(56) References Cited

U.S. PATENT DOCUMENTS

| | | | | |
|---|---|---|---|---|
| 6,709,228 | B2 | 3/2004 | Stuart | |
| 2013/0129482 | A1* | 5/2013 | Tsutsui | F04D 19/042 415/118 |
| 2015/0240829 | A1* | 8/2015 | Ohtachi | F04D 19/042 416/144 |
| 2016/0273552 | A1* | 9/2016 | Tsubokawa | F04D 29/584 |

FOREIGN PATENT DOCUMENTS

JP 2003-129990 A 5/2003

* cited by examiner

*Primary Examiner* — Nicole Ippolito

(74) *Attorney, Agent, or Firm* — Renner Otto Boisselle & Skalr, LLP

(57) ABSTRACT

One or more through-holes communicating with one or more of the plurality of screw grooves are formed at the cylindrical stator, a total of circumferential dimensions of the one or more through-holes formed at the cylindrical stator is set at equal to or greater than a circumferential dimension of an outer peripheral surface region of the cylindrical stator facing the second suction port, and a gas path through which inflow gas through the second suction port is guided to a screw groove is provided, the one or more through-holes penetrating through the screw groove and the screw groove being apart from the region facing the second suction port.

4 Claims, 12 Drawing Sheets

1

D1-D1 CROSS SECTION

D2-D2 CROSS SECTION

VACUUM PUMP AND MASS SPECTROMETER

BACKGROUND OF THE INVENTION

1. Technical Field

The present invention relates to a vacuum pump and a mass spectrometer.

2. Background Art

Vacuum pumps such as turbo-molecular pumps have been used for various devices as the pumps being able to generate clean high-vacuum environment. An example of these devices is a mass analyzer. In the mass analyzer, the degree of vacuum in a quadrupole rod or a detector is set at about five to ten times higher than the degree of vacuum in an ion source. For this reason, a vacuum pump provided with a plurality of suction ports has been known so that a single vacuum pump is applicable to the above-described devices (see, e.g., Patent Literature 1 (JP-A-2003-129990)).

The vacuum pump described in Patent Literature 1 includes first and second turbo-molecular stages and a Holweck stage. Such a pump further includes a first suction port for a flow into the first turbo-molecular stage, a second suction port for a flow in between the first and second turbo-molecular stages, and a third suction port for a flow into the Holweck stage. A through-hole communicating with the third suction port is formed on a stator side of the Holweck stage.

Plural spiral grooves are formed at a stator of the Holweck stage, and gas is exhausted from each spiral groove. However, in the vacuum pump described in Patent Literature 1, the through-hole penetrates through only some of the spiral grooves, and for this reason, a gas flow rate varies among the spiral grooves. As a result, the suction-side pressure of the Holweck stage increases, leading to worse exhaust performance of the entire pump.

SUMMARY OF THE INVENTION

A vacuum pump comprises: a first pump stage; a second pump stage provided on a pump downstream side of the first pump stage, and including a cylindrical stator configured such that a plurality of screw grooves and a plurality of screw threads are alternately formed in an inner peripheral surface circumferential direction, and a cylindrical rotor provided on an inner peripheral side of the cylindrical stator; a first suction port provided on an upstream side of the first pump stage; and a second suction port provided on an downstream side of the first pump stage and communicating with the second pump stage. One or more through-holes communicating with one or more of the plurality of screw grooves are formed at the cylindrical stator, a total of circumferential dimensions of the one or more through-holes formed at the cylindrical stator is set at equal to or greater than a circumferential dimension of an outer peripheral surface region of the cylindrical stator facing the second suction port, and a gas path through which inflow gas through the second suction port is guided to a screw groove is provided, the one or more through-holes penetrating through the screw groove and the screw groove being apart from the region facing the second suction port.

The gas path includes at least one of a groove formed at an outer peripheral surface of the cylindrical stator or a groove formed at an inner peripheral surface of a pump housing provided to cover an outer peripheral side of the cylindrical stator.

The gas path is formed facing an entire opening area of the one or more through-holes.

A mass spectrometer comprises: the vacuum pump; a first analysis unit; a second analysis unit configured to operate in a higher pressure region than that of the first analysis unit; a first chamber in which the first analysis unit is housed and which is provided with a first exhaust port connected to the first suction port of the vacuum pump; and a second chamber in which the second analysis unit is housed and which is provided with a second exhaust port connected to the second suction port of the vacuum pump.

According to the present invention, exhaust performance can be improved in the vacuum pump provided with the exhaust ports.

DETAILED DESCRIPTION OF THE EXEMPLARY EMBODIMENTS

Hereinafter, embodiments of the present invention will be described with reference to the drawings.

First Embodiment

Figure 1:
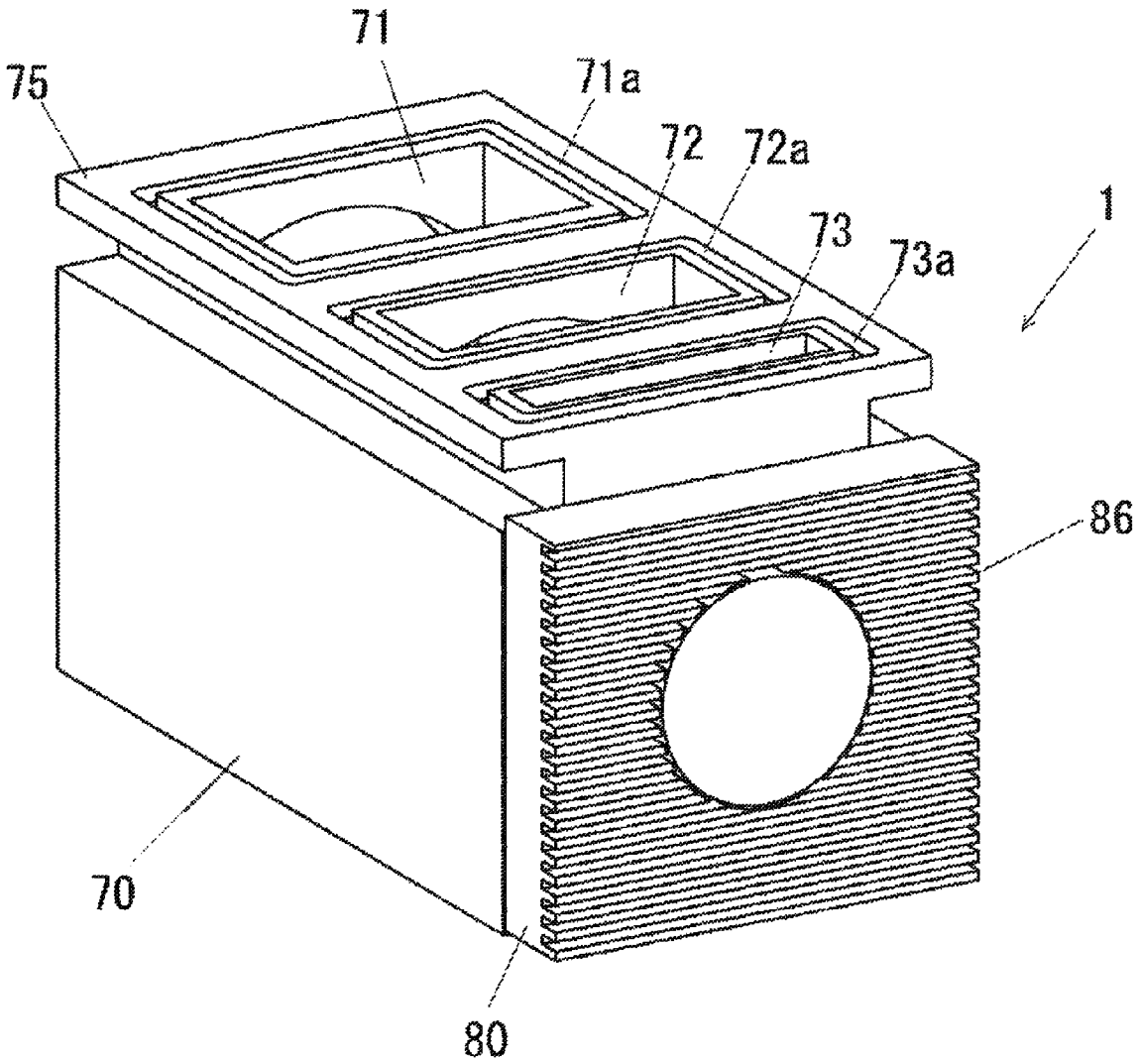
FIG. 1 is a perspective view of an appearance of an example of a vacuum pump of a first embodiment of the present invention.

FIG. 1 is a perspective view of an appearance of a vacuum pump of an embodiment of the present invention. A vacuum pump 1 includes a first housing 70 and a second housing 80. The first housing 70 includes a flange portion 75, the flange portion 75 being provided with a first suction port 71, a second suction port 72, and a third suction port 73. Seal ring grooves 71*a*, 72*a*, 73*a* to each of which a seal ring is attached are formed respectively at the first, second, and third suction ports 71, 72, 73. A motor is, as described later, provided at the second housing 80, and heat dissipation fins 86 are formed on the surface of the second housing 80 (i.e., the bottom surface of the vacuum pump 1).

Figure 2:
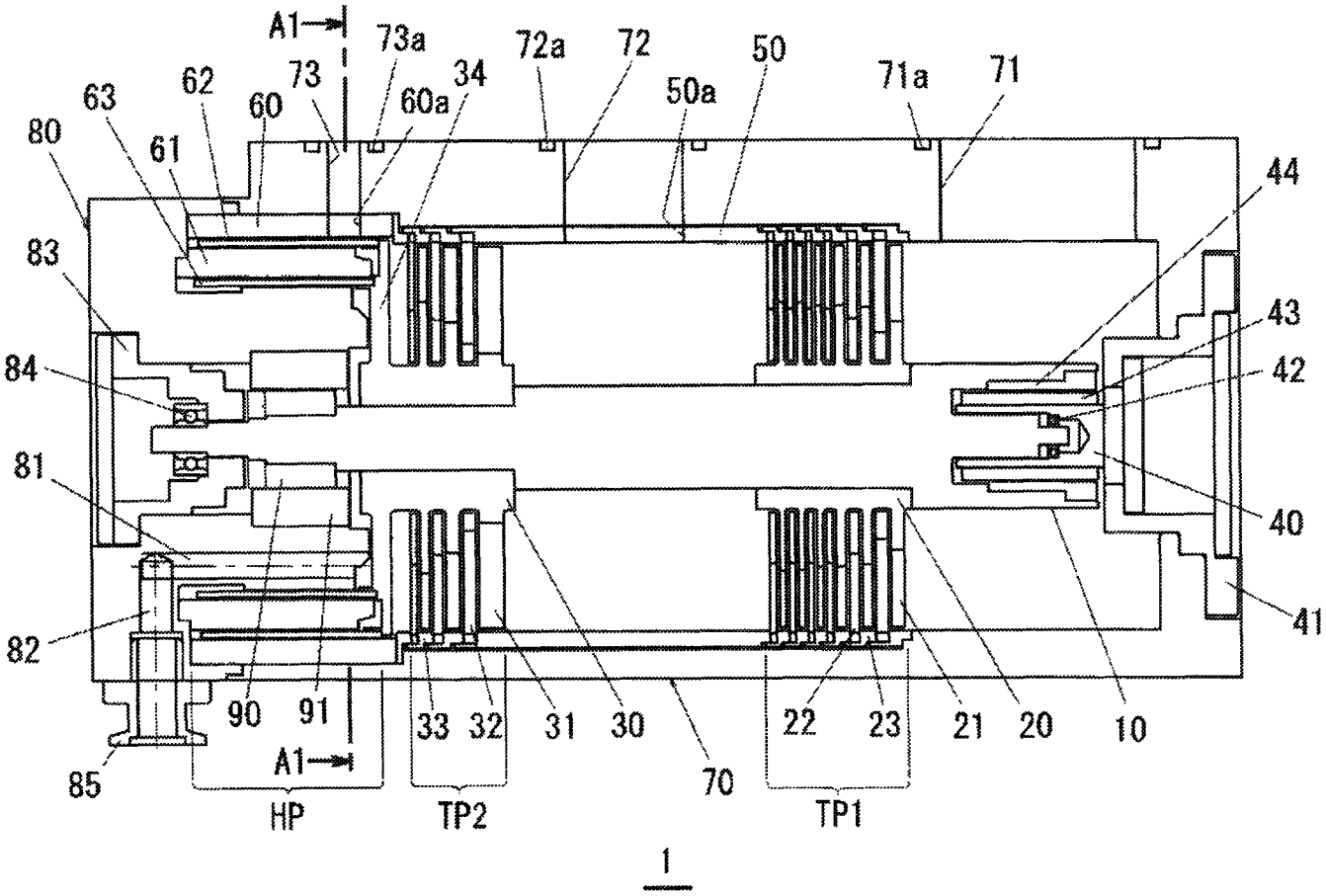
FIG. 2 is a cross-sectional view of the vacuum pump along the axial direction thereof.
Figure 3:
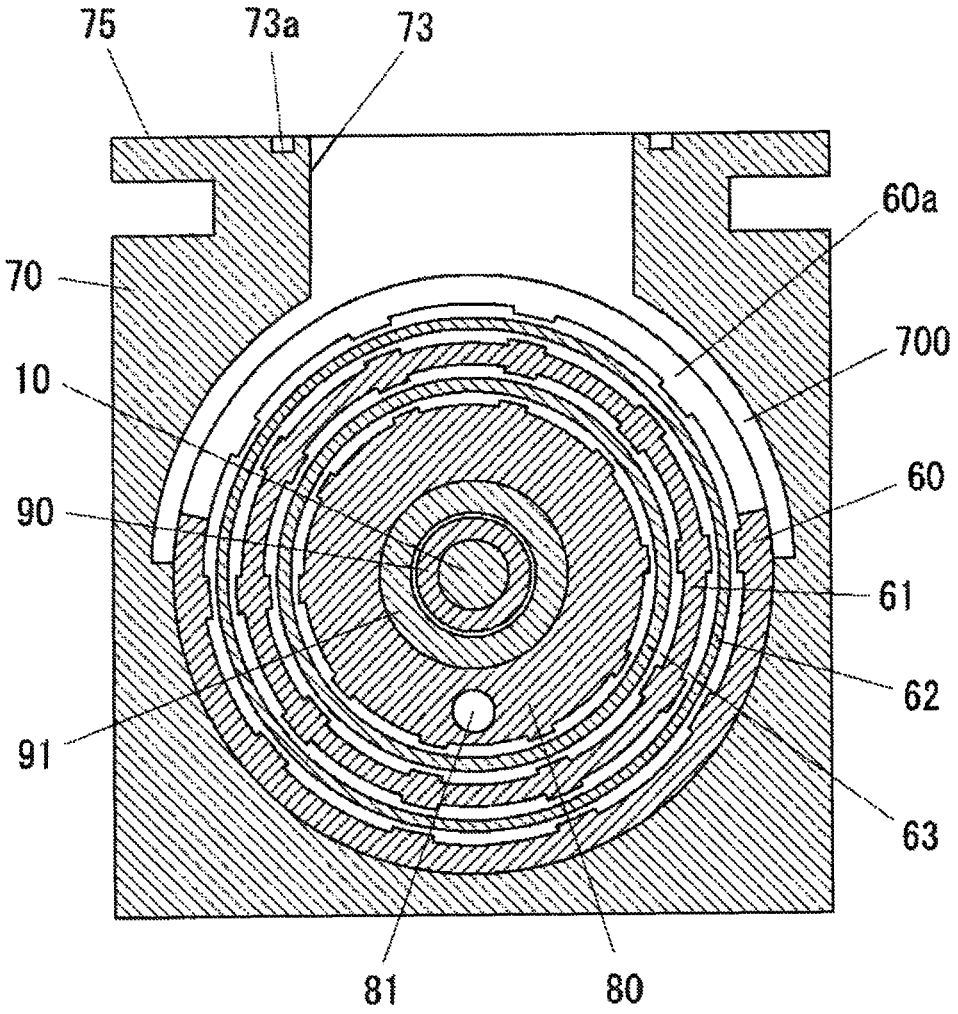
FIG. 3 is a cross-sectional view along an A1-A1 line of FIG. 2.

FIG. 2 is a cross-sectional view of the vacuum pump 1 along the axial direction thereof. Moreover, FIG. 3 is a cross-sectional view along an A1-A1 line of FIG. 2. A shaft 10 to which a first turbine rotor 20, a second turbine rotor 30, and a motor rotor 90 are fixed is provided in the first housing 70. The shaft 10 is supported by a magnetic bearing using permanent magnets 43, 44 and a ball bearing 84. A motor stator 91 provided on the outer peripheral side of the motor rotor 90 is held by the second housing 80. The ball bearing 84 is held by a bearing holder 83 fixed to the second housing 80.

The permanent magnet 44 is fixed in the recess formed at a right end portion of the shaft 10 as viewed in the figure. The permanent magnet 43 disposed inside the permanent magnet 44 is held by a magnet holder 40. The magnet holder 40 is fixed to a holder support 41, and the holder support 41 is fixed to the first housing 70. The magnet holder 40 is provided with a ball bearing 42. The ball bearing 42 functions as a restriction member for restricting whirling of the shaft 10 to avoid contact between the permanent magnet 44 and the permanent magnet 43 or turbine blade stages and stationary blade stage.

Plural first turbine blade stages 21 with plural turbine blades are formed in the axial direction at the first turbine rotor 20. The first turbine blade stages 21 and plural stationary blade stages 22 with plural turbine blades are alternately arranged in the axial direction. The first turbine blade stages 21 and the first stationary blade stages 22 form a first turbo-molecular pump stage TP1.

Plural second turbine blade stages 31 with plural turbine blades are formed in the axial direction (the right-left direction as viewed in the figure) at the second turbine rotor 30. The second turbine blade stages 31 and plural second stationary blade stages 32 with plural turbine blades are alternately arranged in the axial direction. The second turbine blade stages 31 and the second stationary blade stages 32 form a second turbo-molecular pump stage TP2. The positions of the first stationary blade stages 22 and the second stationary blade stages 32 in the axial direction are determined by spacers 23, 33, 50.

A discoid portion 34 is formed on a pump downstream side (the left side as viewed in the figure) of the second turbine blade stages 31 of the second turbine rotor 30. A first cylindrical rotor 62 and a second cylindrical rotor 63 are fixed to the discoid portion 34. The second cylindrical rotor 63 is disposed on the inner peripheral side of the first cylindrical rotor 62. A first screw stator 60 is provided on the outer peripheral side of the first cylindrical rotor 62, and a second screw stator 61 is provided between the first cylindrical rotor 62 and the second cylindrical rotor 63. In the first screw stator 60, a through-hole 60*a* is formed facing the third suction port 73 of the first housing 70.

As illustrated in FIG. 3, screw grooves and screw threads are formed at the inner peripheral surface of the first screw stator 60, the outer and inner peripheral surfaces of the second screw stator 61, and the surface of the second housing 80 facing the inner peripheral surface of the second cylindrical rotor 63. The first cylindrical rotor 62, the second cylindrical rotor 63, the first screw stator 60, the second screw stator 61, and the screw grooves and threads of the facing surface of the second housing 80 form a Holweck pump stage HP.

The inflow gas through the first suction port 71 of FIG. 2 is exhausted toward the downstream side of the first turbo-molecular pump stage TP1 by the first turbo-molecular pump stage TP1. Moreover, the inflow gas through the second suction port 72 and the gas exhausted by the first turbo-molecular pump stage TP1 are exhausted toward the downstream side of the second turbo-molecular pump stage TP2 by the second turbo-molecular pump stage TP2. The gas exhausted by the second turbo-molecular pump stage TP2 and the inflow gas through the third suction port 73 are exhausted by the Holweck pump stage HP. The gas exhausted by the Holweck pump stage HP passes through exhaust paths 81, 82 formed at the second housing 80, and then, is exhausted through an exhaust port 85. The pressures P at the first suction port 71, the second suction port 72, and the third suction port 73 increase toward the downstream side as in P(71)<P(72)<P(73).

Figure 4:
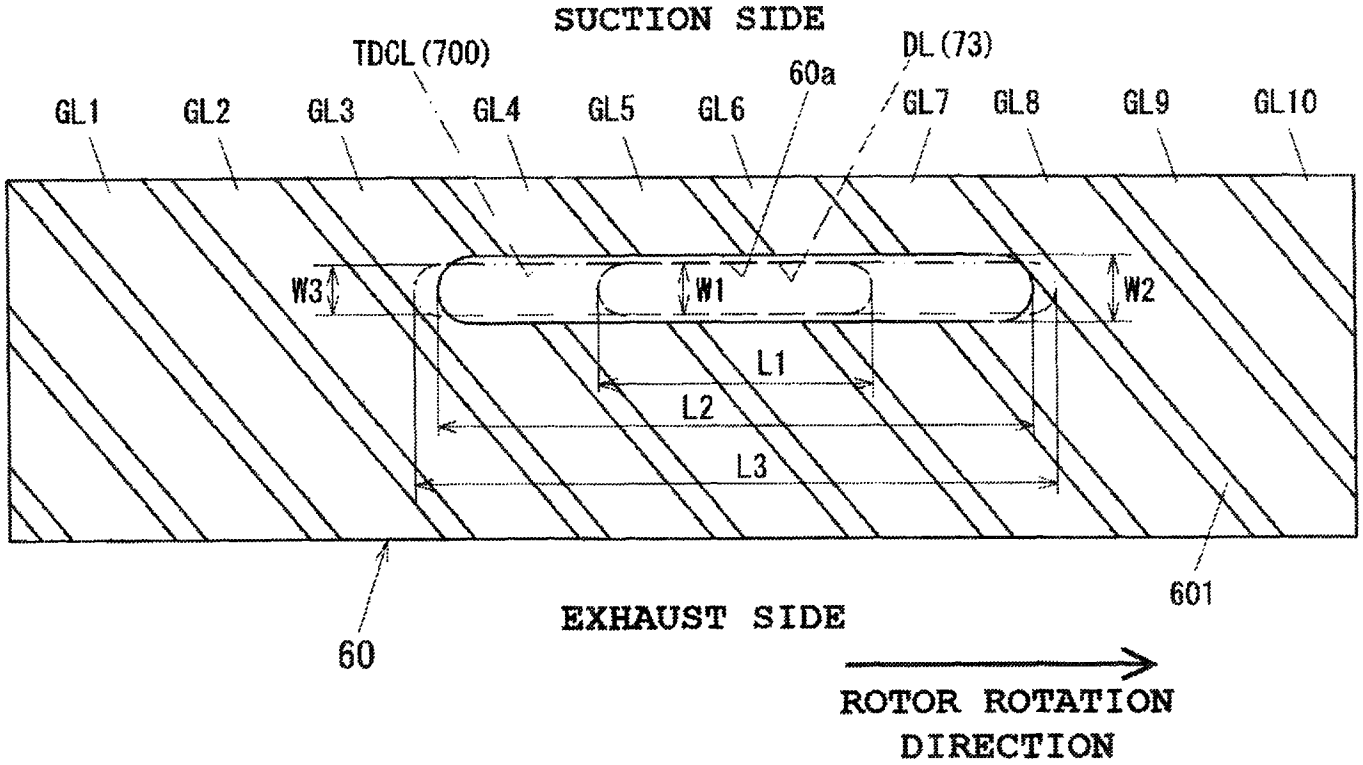
FIG. 4 is an exploded view for describing the inner-peripheral-side shape of a first screw stator.

FIG. 4 is an exploded view for describing the inner-peripheral-side shape of the first screw stator 60. At the inner peripheral surface of the first screw stator 60 (i.e., the surface facing the first cylindrical rotor 62), the screw grooves and the screw threads are alternately formed. In the example illustrated in FIG. 4, ten screw grooves GL1 to GL10 and ten screw threads 601 are formed. The screw grooves GL1 to GL10 and the screw threads 601 incline from a suction side to an exhaust side in a rotor rotation direction.

The through-hole 60*a* formed at the first screw stator 60 is formed in the shape elongated in the circumferential direction of the first screw stator 60 to extend across the screw grooves GL3 to GL7. A dashed line DL indicates the unfolded shape of the stator outer peripheral surface region facing the third suction port 73, i.e., the shape when an arc-shaped region is unfolded to a planar region. Moreover, a two-dot chain line TDCL indicates the unfolded shape of a gas path 700 formed at the inner peripheral surface of the first housing 70. The gas path 700 is formed to extend from the third suction port 73 in the circumferential direction.

The dimension of the through-hole 60*a* in the circumferential direction (the right-left direction as viewed in the figure) is set at L2, and the dimension in the axial direction (the dimension in the upper-lower direction as viewed in the figure) is set at W2. Similarly, the circumferential dimension of the stator outer peripheral surface region facing the third suction port 73 is set at L1, and the axial dimension is set at W1. Further, the circumferential dimension of the region indicated by the two-dot chain line TDCL for the gas path 700 is set at L3, and the axial dimension thereof is set at W3. In the example illustrated in FIG. 4, these dimensions are set as in L1≤L2≤L3 and W1=W3≤W2.

With a setting of L1≤L2, the inflow gas through the third suction port 73 can be effectively introduced into the screw grooves. On the other hand, in the case of a setting of L1>L2, the conductance from the third suction port 73 to the through-hole region not facing the third suction port 73 decreases, and for this reason, the flow rate of gas exhausted from the screw grooves decreases as compared to the amount of inflow gas through the third suction port 73. As a result, the pressure at the third suction port 73 might increase. That is, in order to further decrease the pressure at the third suction port 73, a setting of L1≤L2 is preferable.

The circumferential dimension L3 of the gas path 700 is preferably set as in L2≤L3 such that the gas path 700 is formed facing at least the entire opening area of the through-hole 60*a*. With such a setting, the amount of gas flowing into each of the screw grooves GL3 to GL7 communicating with the through-hole 60*a* can be more uniform. Needless to say, even if L2>L3, although the gas flow rate uniformization effect is less exhibited, the gas path 700 has the function of guiding gas from the third suction port 73 to each of the screw grooves GL3 to GL7.

Figure 5B:
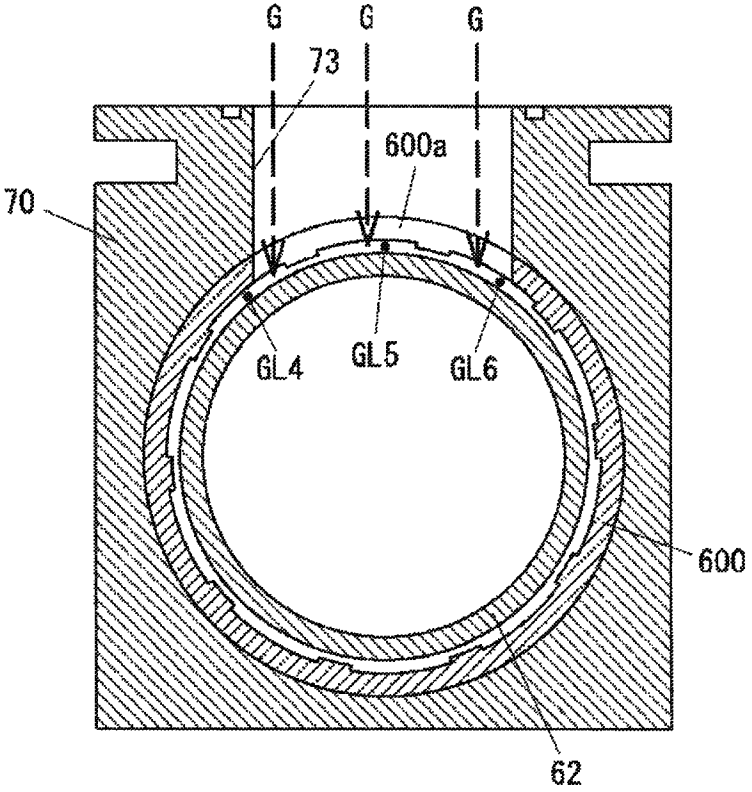
FIGS. 5A and 5B are views for comparing a pump configuration of the present embodiment with a configuration of a conventional vacuum pump.
Figure 5A:
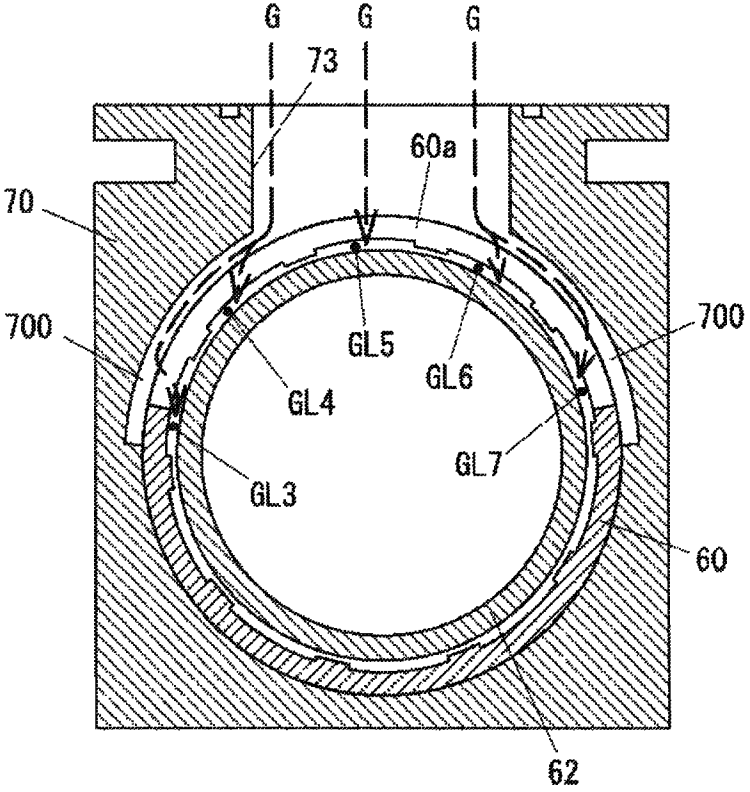

FIGS. 5A and 5B are views for comparing the pump configuration of the present embodiment as illustrated in FIGS. 3 and 4 with a configuration of a conventional vacuum pump (e.g., the vacuum pump described in Patent Literature 1). Each view is a cross-sectional view of a portion including the third suction port 73 along the direction perpendicular to the pump shaft, and a configuration inside the first cylindrical rotor 62 is not shown in the figure.

FIG. 5B illustrates the example of the conventional pump, and a through-hole 600*a* formed at a first screw stator 60 is formed only in the region facing a third suction port 73. Thus, the inflow gas through the third suction port 73 flows into screw grooves GL4, GL5, GL6 through which the through-hole 600*a* penetrates. However, no gas flows into other screw grooves GL1 to GL3, GL7, GL10. As a result, the gas flow rate in the screw grooves GL4, GL5, GL6 is greater than that in other screw grooves GL1 to GL3, GL7, GL10.

Typically, the pressure at the third suction port 73 is more than ten times higher than the pressure at the second suction port 72. Thus, the suction-side pressure of the Holweck pump stage HP is controlled by the suction-side pressure of each screw groove at which the through-hole 60*a* is formed. In comparison between FIGS. 5A and 5B, since the number of screw grooves into which gas flows is greater in the configuration of FIG. 5A, the suction-side pressure of each screw groove can be lower in the configuration of FIG. 5A. As a result, exhaust performance of the vacuum pump 1 can be improved.

In the case of the embodiment illustrated in FIG. 5A, the inflow gas through the third suction port 73 flows into the pump as indicated by dashed arrows G. The inflow gas flows not only into the screw grooves GL4, GL5, GL6 provided in the region facing the third suction port 73, but also into the screw grooves GL3, GL7 through the gas path 700. Moreover, the circumferential dimension L2 of the through-hole 60*a* is greater than that in the case of FIG. 5B, and the gas path 700 is formed. Thus, the conductance from the outlet of the third suction port 73 to the screw groove GL4, GL6 is greater than that in the case of FIG. 5B. As a result, the amount of gas flowing into the screw groove GL4, GL6 increases. In the case of the configuration illustrated in FIG. 5A, gas can flow into more of the screw grooves GL1 to GL10 through the third suction port 73, and the flow rate can be more uniform among the screw grooves as compared to the conventional case.

As described above, in order to introduce gas into more of the screw grooves through the third suction port 73, the circumferential dimension L2 of the through-hole 60*a* is preferably equal to or greater than the circumferential dimension L1 of the region (the region indicated by the dashed line DL of FIG. 4) facing the third suction port 73, as illustrated in FIG. 4. Note that in such a configuration, the conductance from the third suction port 73 to the screw groove is smaller in the case of the screw groove (e.g., the screw groove GL3 of FIG. 5A) in the region not facing the third suction port 73 than in the case of the screw groove in the region facing the third suction port 73. In the present embodiment, the gas path 700 is provided so that sufficient gas flows into the screw grooves positioned apart from the region facing the third suction port 73.

Even in the case where no gas path 700 is provided in the configuration of FIG. 5A, gas flows, through the through-hole 60*a*, into the screw grooves GL3, GL7 formed in the region not facing the third suction port 73. However, as compared to the screw groove GL5 provided right below the third suction port 73, the conductance from the third suction port 73 to the screw grooves GL3, GL7 is smaller. Thus, in the present embodiment, the gas path 700 is provided to improve the conductance to the screw grooves GL3, GL7, and in this manner, the flow rate uniformization effect is enhanced.

Figure 6:
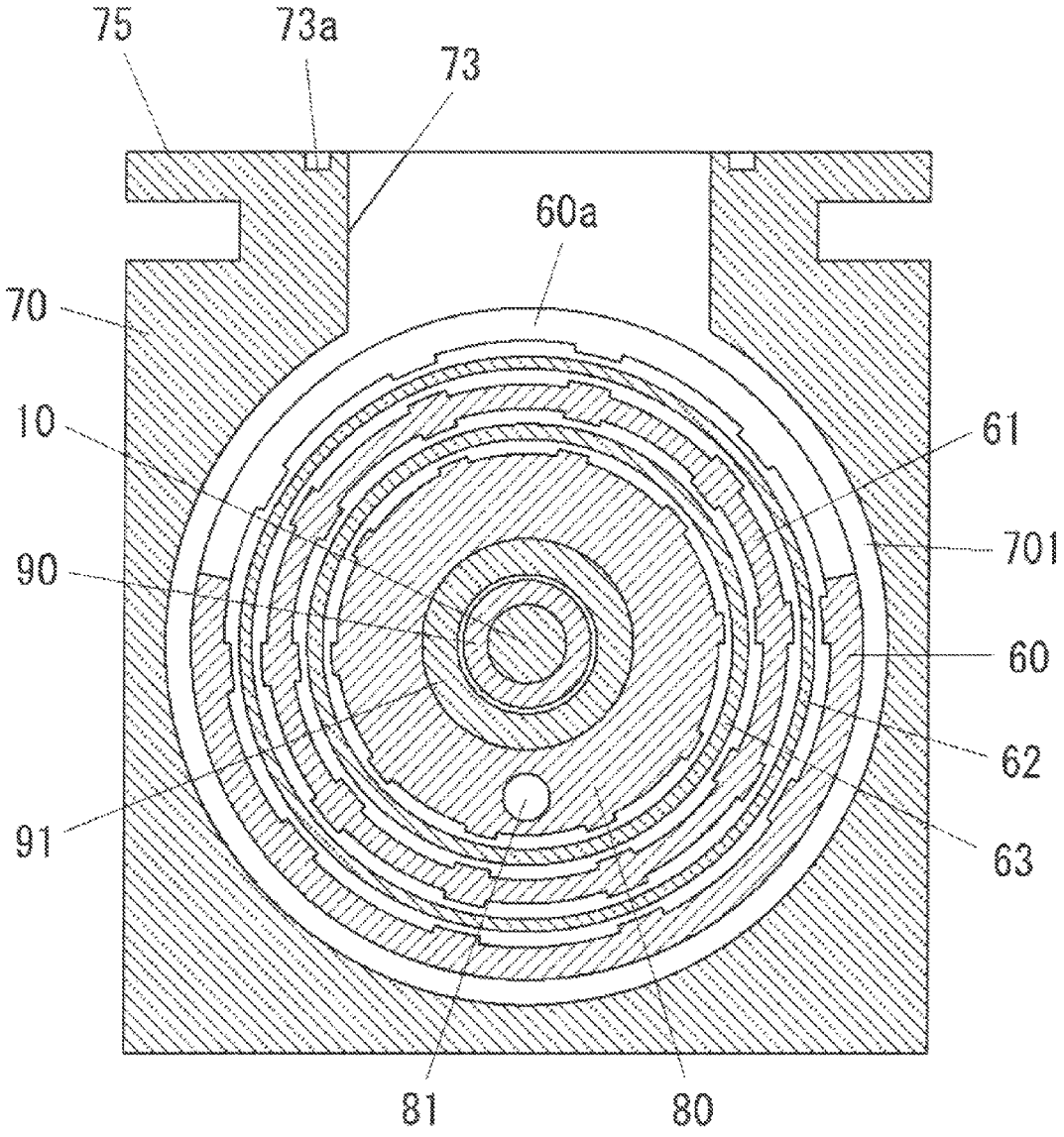
FIG. 6 is a view of a first variation of the first embodiment.

FIG. 6 is a view of a first variation of the above-described embodiment. In the first variation illustrated in FIG. 6, a gas path 701 is formed across the entirety of the inner peripheral surface of the first housing 70 in the circumferential direction. Other configuration is similar to the configuration illustrated in FIG. 3. In this case, advantageous effects similar to those of the configuration of FIG. 3 can be provided.

Figure 7:
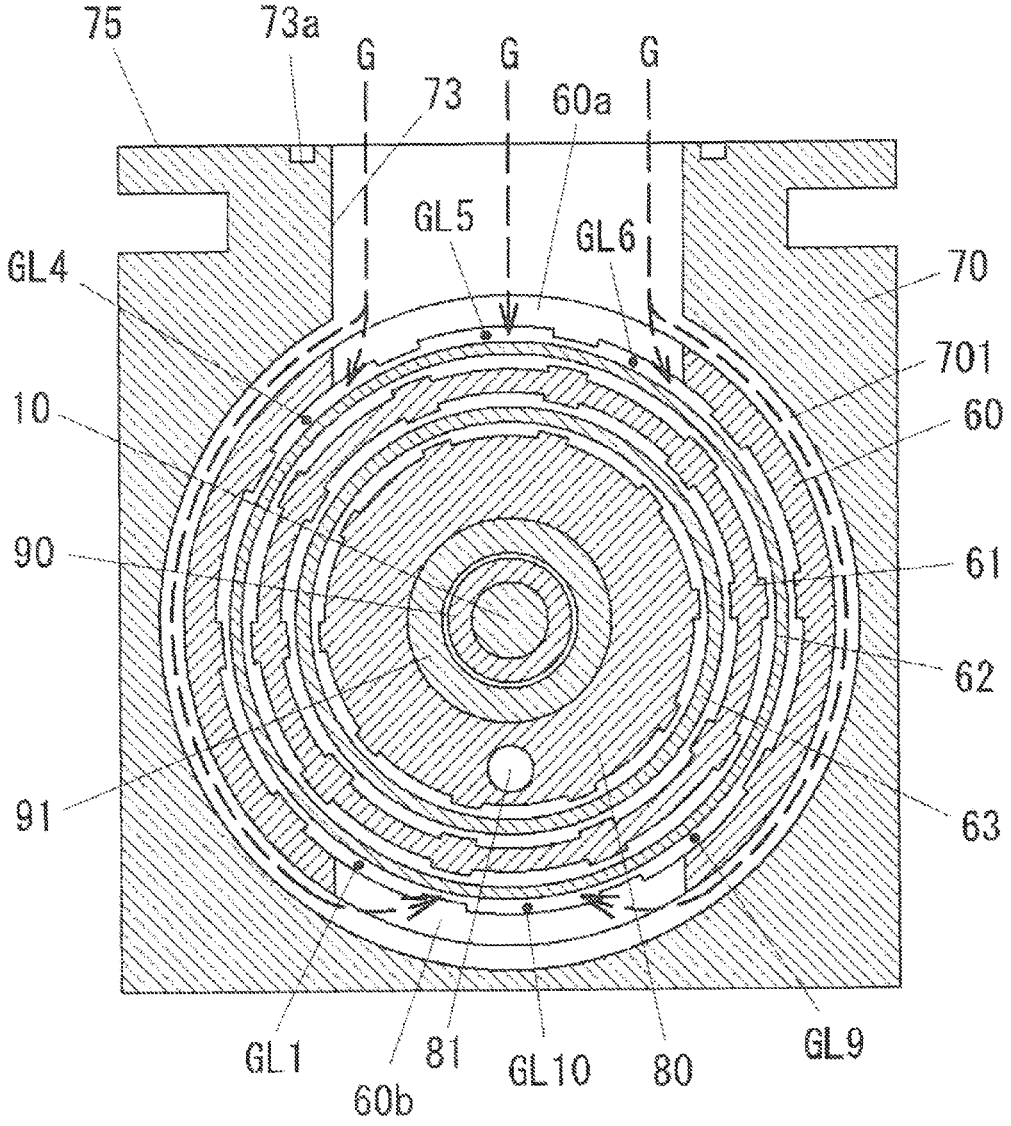
FIG. 7 is a view of a second variation of the first embodiment.

FIG. 7 is a view of a second variation of the above-described embodiment. In the vacuum pump illustrated in FIG. 3, only the single through-hole 60*a* formed at the first screw stator 60 is provided facing the third suction port 73. In the first screw stator 60 of the second variation, the through-hole 60*a* is provided facing the third suction port 73, and a second through-hole 60*b* is formed at the position whose phase is different from that of the through-hole 60*a* by 180 degrees. The gas path 701 similar to that in the case of the first variation illustrated in FIG. 6 is formed at the inner peripheral surface of the first housing 70. In this case, the gas path 701 is also formed facing the entire opening area of each through-hole 60*a*, 60*b*.

As indicated by the arrows G, part of the inflow gas through the third suction port 73 flows into the screw grooves GL4, GL5, GL6 through the through-hole 60*a*, and the remaining gas flows into the screw grooves GL1, GL9, GL10 from through-hole 60*b* through the gas path 701. That is, in the third variation, the inflow gas through the third suction port 73 flows into six screw grooves GL1, GL4 to GL6, GL9, GL10 of the screw grooves GL1 to GL10. As a result, the pressure becomes more uniform among the grooves as compared to the conventional configuration illustrated in FIG. 5B. Moreover, the suction-side pressure of each screw groove can be lower, and therefore, performance of the vacuum pump can be improved.

Second Embodiment

Figure 8B:
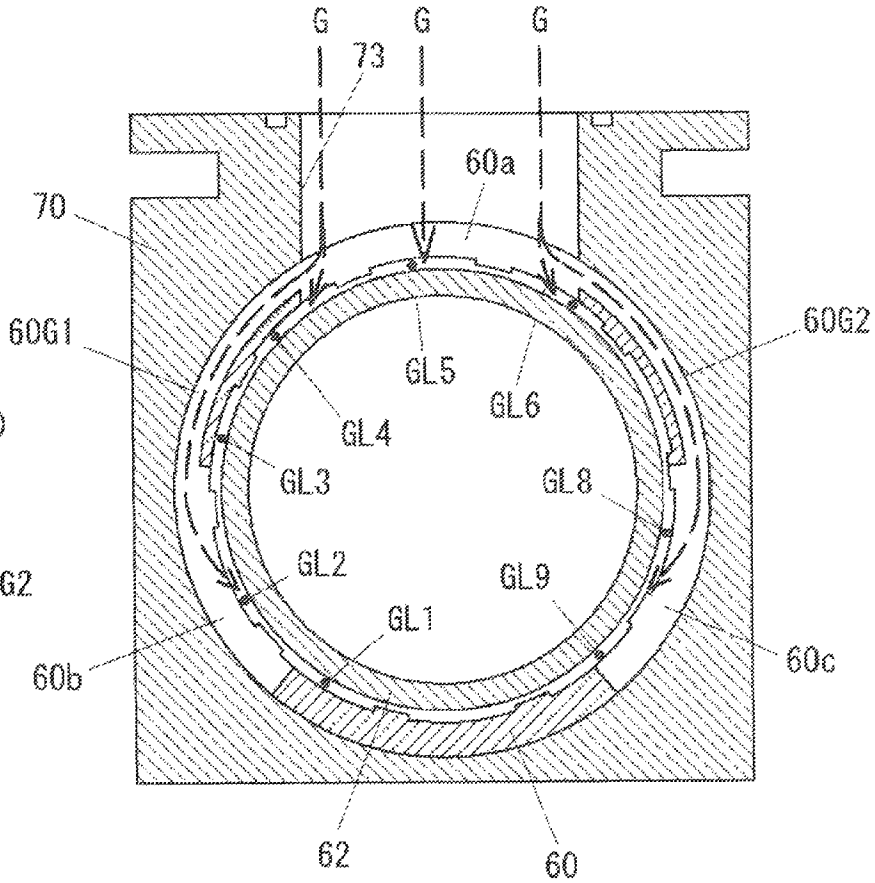
FIGS. 8A and 8B are views of an example of a second embodiment.
Figure 8A:
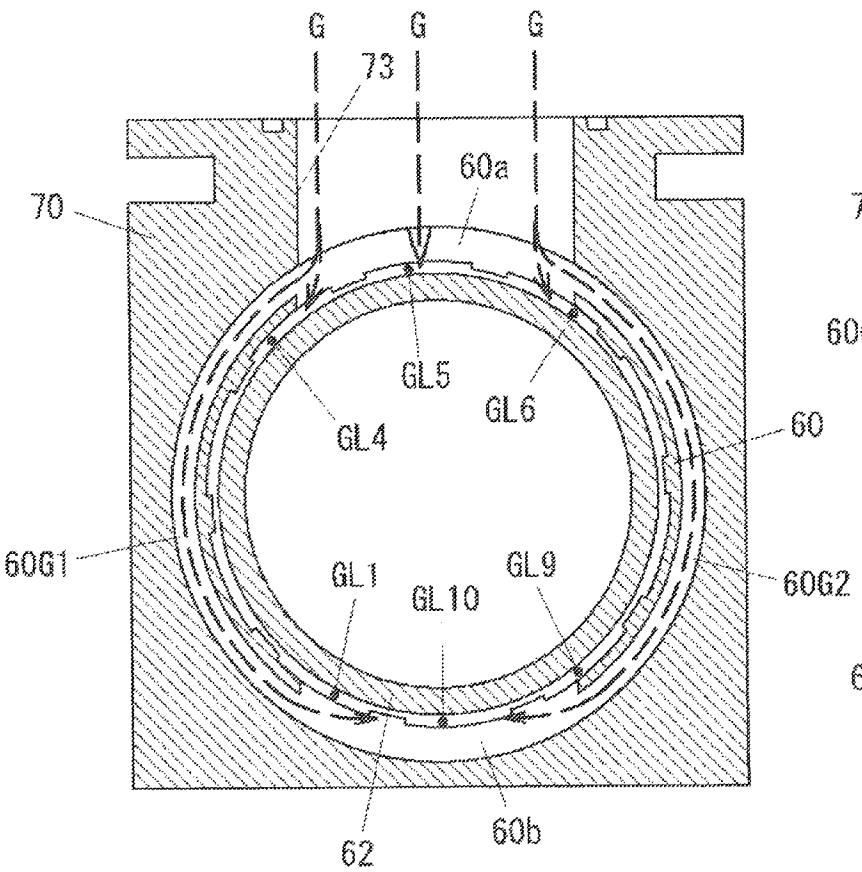

FIGS. 8A and 8B are views of a vacuum pump of a second embodiment of the present invention. In the above-described first embodiment, the gas paths 700, 701 are formed at the inner peripheral surface of the first housing 70. However, in the second embodiment, gas paths are formed at the outer peripheral surface of a first screw stator 60. In the example illustrated in FIG. 8A, a through-hole 60*a* provided facing a third suction port 73 and a through-hole 60*b* whose phase is different from the through-hole 60*a* by 180 degrees are formed at the first screw stator 60. In addition, gas paths 60G1, 60G2 connecting between the third suction port 73 and the through-hole 60*b* are formed at the outer peripheral surface of the first screw stator 60.

Figure 9:
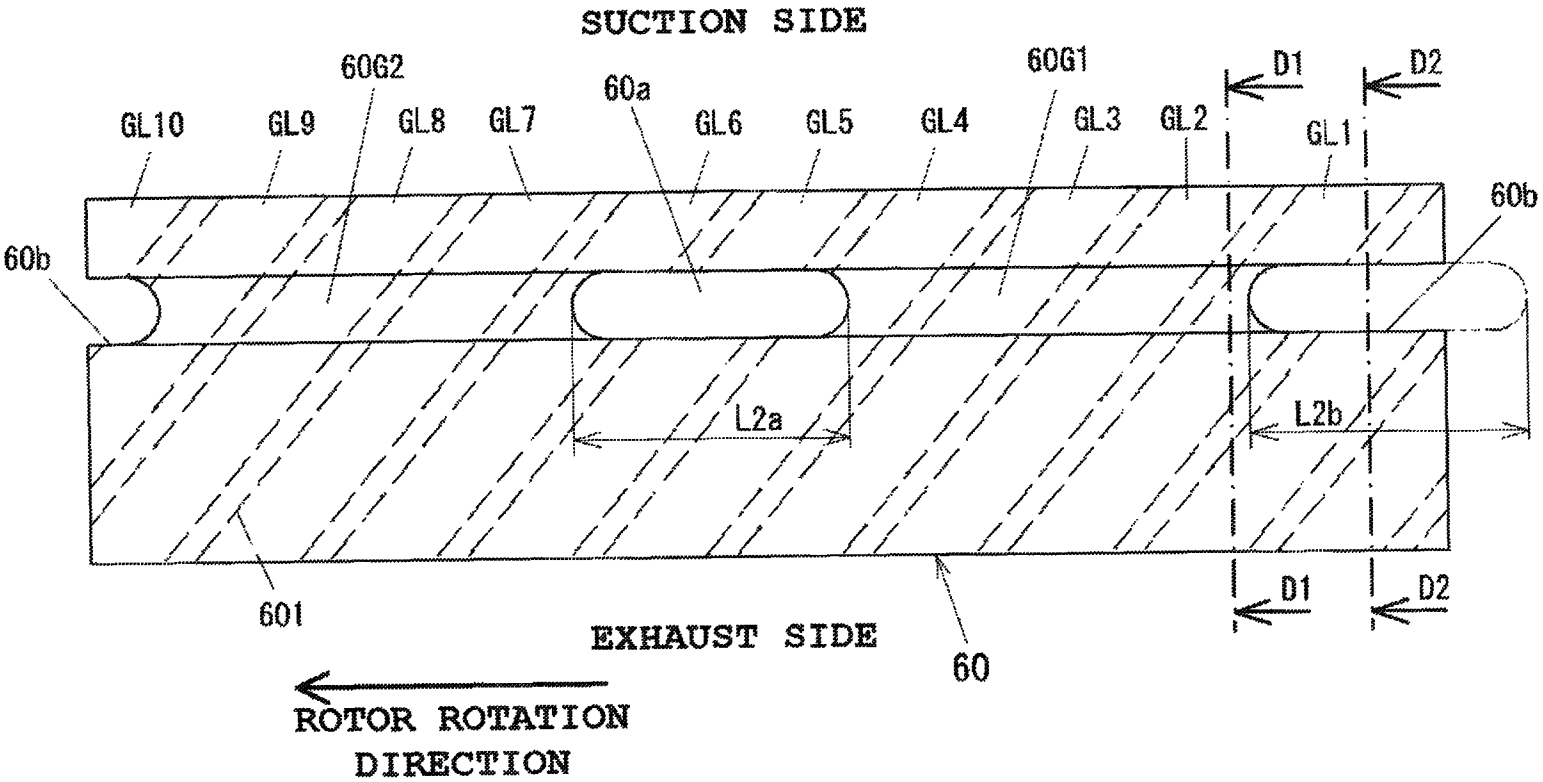
FIG. 9 is an exploded view of an outer peripheral side of a first screw stator illustrated in FIG. 8A.

FIG. 9 is an exploded view of the outer peripheral surface side of the first screw stator 60 illustrated in FIG. 8A. The through-hole 60*a* communicates with screw grooves GL4, GL5, GL6, and the through-hole 60*b* communicates with screw grooves GL1, GL9, GL10. In the case where the two through-holes 60*a*, 60*b* are formed at the first screw stator 60 as described above, the total L2 (=L2*a*+L2*b*) of the circumferential dimension L2*a* of the through-hole 60*a* and the circumferential dimension L2*b* of the through-hole 60*b* is preferably set as in L1≤L2 in association with the circumferential dimension L1 of the stator outer peripheral surface region facing the third suction port 73. Note that the same applies to the case where the gas path 701 is formed at the first housing 70 as illustrated in FIG. 7.

Moreover, the same also applies to the case where three or more through-holes are formed. The total of the circumferential dimensions of one or more through-holes formed at the first screw stator 60 is preferably set at equal to or greater than the circumferential dimension of the outer peripheral surface region of the first screw stator 60 facing the third suction port 73.

Figure 10A:
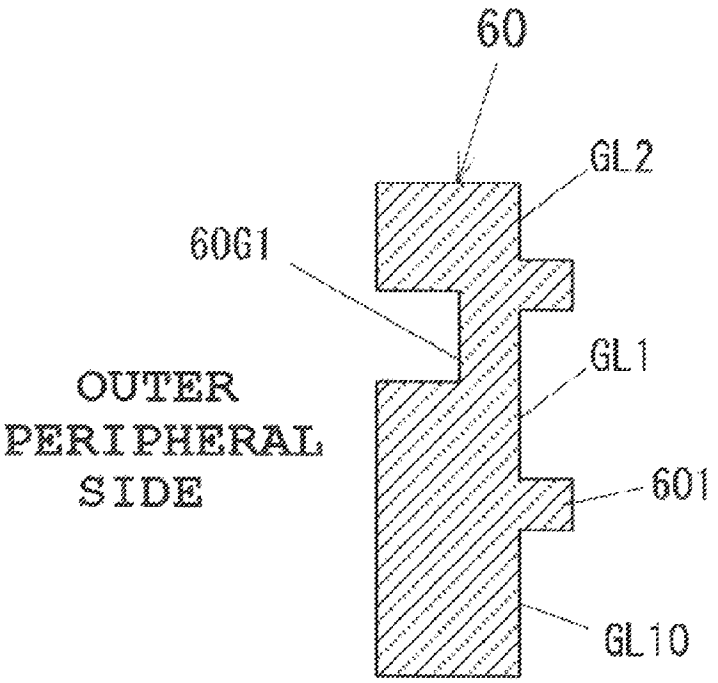
FIGS. 10A and 10B are views of a cross section along a D1-D1 line of FIG. 9 and a cross section along a D2-D2 line of FIG. 9.
Figure 10B:
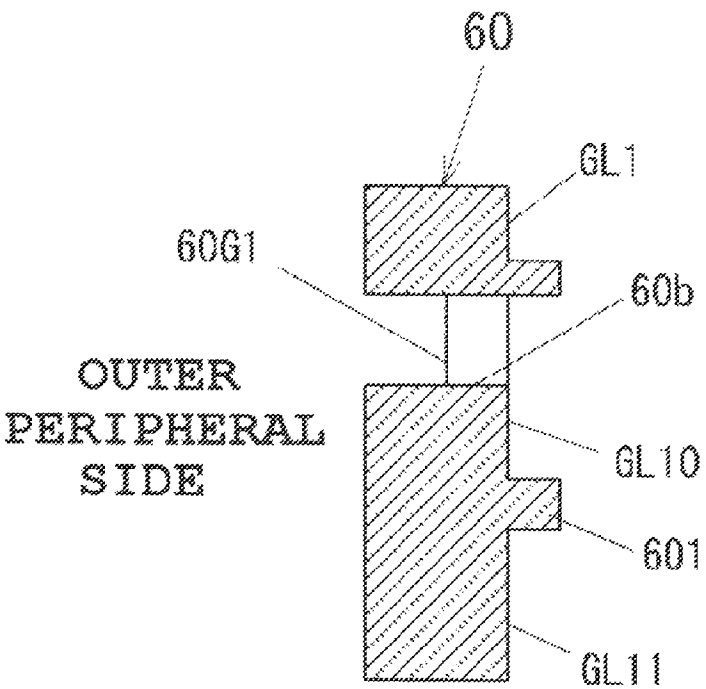

FIG. 10A is a view of a cross section along a D1-D1 line of FIG. 9, and FIG. 10B is a view of a cross section along a D2-D2 line of FIG. 9. A groove having a rectangular cross-sectional shape is formed across the entire circumference of the outer peripheral surface of the first screw stator 60, and the gas path 60G1, 60G2 forms part of the rectangular groove. In the D2-D2 cross section of FIG. 10B, the gas path 60G1 communicates, through the through-hole 60*b*, with the screw groove GL10 formed on the inner peripheral side.

FIG. 8B illustrates the case where three through-holes are formed. A through-hole 60*a* provided facing a third suction port 73 and two through-holes 60*b*, 60*c* whose phases are different from that of the through-hole 60*a* are formed at a first screw stator 60. The left through-hole 60*b* as viewed in the figure is connected to the third suction port 73 through a gas path 60G1. The right through-hole 60*c* as viewed in the figure is connected to the third suction port 73 through a gas path 60G2. As a result, the inflow gas through the third suction port 73 flows into screw grooves GL1 to GL6, GL8, GL9 through the through-holes 60*a* to 60*c*.

Note that in the case of the first embodiment in which the gas path is formed at the inner peripheral surface of the first housing 70, the number of through-holes can be set at three or more as in the case illustrated in FIG. 8B.

(Mass Spectrometer)

Figure 11:
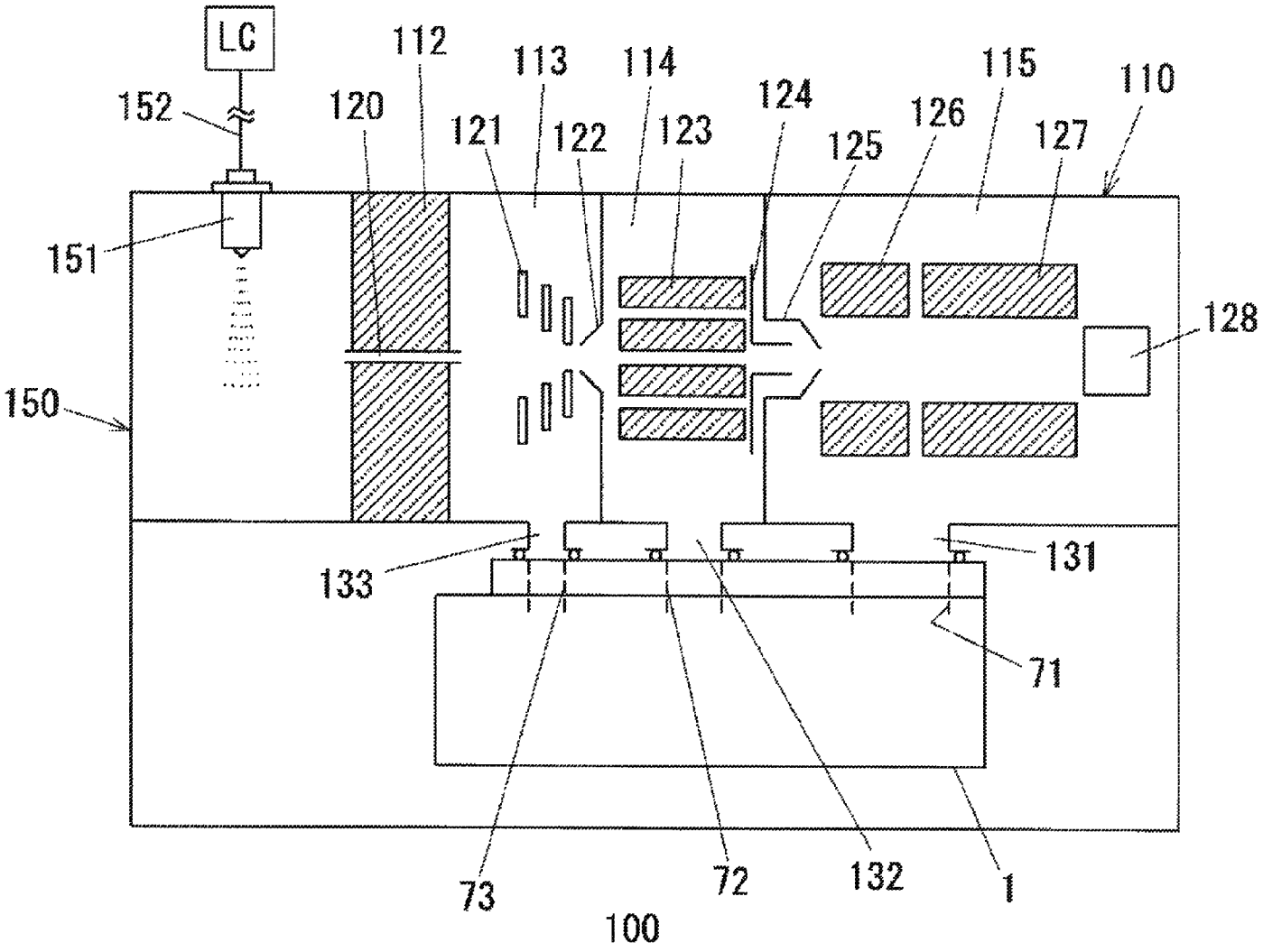
FIG. 11 is a view of an example of a mass spectrometer.

FIG. 11 is a view of an example of a mass spectrometer 100 on which a vacuum pump 1 including three suction ports 71 to 73 is mounted. FIG. 11 is a schematic view of an outline configuration of a liquid chromatographic mass spectrometer using electrospray ionization (ESI). The mass spectrometer 100 includes an ionization chamber 150 and amass analyzer 110. The mass analyzer 110 is configured such that a first intermediate chamber 113 adjacent to the ionization chamber 150, a second intermediate chamber 114 adjacent to the first intermediate chamber, and an analysis chamber 115 adjacent to the second intermediate chamber 114 are provided with a partition wall being interposed between adjacent ones of the chambers.

The first suction port 71 of the vacuum pump 1 is connected to an exhaust port 131 of the analysis chamber 115. The second suction port 72 of the vacuum pump 1 is connected to an exhaust port 132 of the second intermediate chamber 114. The third suction port 73 of the vacuum pump 1 is connected to an exhaust port 133 of the first intermediate chamber 113. As described above, exhaust from three spaces (the first intermediate chamber 113, the second intermediate chamber 114, and the analysis chamber 115) different from each other in a pressure region is performed using the single vacuum pump 1.

An ionization spray 151 is provided in the ionization chamber 150. A liquid sample subjected to component separation by a liquid chromatographic part LC is supplied to the ionization spray 151 through a pipe 152. Although not shown in the figure, nebulizer gas is supplied to the ionization spray 151, and the liquid sample is sprayed from the ionization spray 151. High voltage is applied to a tip end of the ionization spray 151, and ionization is performed in sample spraying. A heater block 112 is provided between the first intermediate chamber 113 and the ionization chamber 150. A desolvation pipe 120 allowing communication between the ionization chamber 150 and the first intermediate chamber 113 is provided in the heater block 112. The desolvation pipe 120 has the function of accelerating desolvation and ionization when the ion generated by the ionization chamber 150 and the liquid drops of the sample pass through the desolvation pipe 120.

A first ion lens 121 is provided in the first intermediate chamber 113. An octopole 123 and a focus lens 124 are provided in the second intermediate chamber 114. An entrance lens 125 formed with a fine pore is provided at the partitioning wall provided between the second intermediate chamber 114 and the analysis chamber 115. A first quadrupole rod 126, a second quadrupole rod 127, and a detector 128 are provided in the analysis chamber 115.

The ions generated by the ionization chamber 150 are sent to the analysis chamber 115 after passing through the desolvation pipe 120, the first ion lens 121 of the first intermediate chamber 113, a skimmer 122, the octopole 123 of the second intermediate chamber 114, the focus lens 124 of the second intermediate chamber 114, and the entrance lens 125 in this order. Then, unnecessary ion is discharged by the quadrupole rods 126, 127, and only particular ion having reached the detector 128 is detected.

According to the above-described embodiments, the following features and advantageous effects are provided.

(1) The vacuum pump 1 includes the plurality of suction ports (the first suction port 71, the second suction port 72, and the third suction port 73) as illustrated in FIGS. 2, 4, 5A, and 5B. The through-hole 60*a* communicating with the screw grooves GL3 to GL7 are formed at the cylindrical first screw stator 60, the screw grooves GL3 to GL7 being formed at the inner peripheral surface of the first screw stator 60 to penetrate through the first screw stator 60. In addition, the circumferential dimension L2 of the through-hole 60*a* is set at equal to or greater than the circumferential dimension L1 of the outer peripheral surface region of the first screw stator 60 facing the third suction port 73. Further, the gas path 700 through which the inflow gas through the third suction port 73 is guided to the screw grooves GL3, GL7 is provided, the through-hole penetrating through the screw grooves GL3, GL7 and the screw grooves GL3, GL7 not facing the third suction port 73.

Since the circumferential dimension L2 of the through-hole 60*a* is set at equal to or greater than L1 as illustrated in FIG. 4, gas can be introduced into more of the screw grooves GL3 to GL7. Moreover, since the gas path 700 is provided as illustrated in FIG. 5A, the conductance to the screw grooves GL3, GL7 not facing the third suction port 73 can be increased, and as a result, the amount of gas flowing into the screw grooves GL3, GL7 can be increased. As a result, the suction-side pressure of the screw groove can be lower, and performance of the vacuum pump can be improved.

In the case where the two through-holes 60*a*, 60*b* are formed at the first screw stator 60 as illustrated in FIG. 9, the total L2 (=L2*a*+L2*b*) of the circumferential dimension L2*a* of the through-hole 60*a* and the circumferential dimension L2*b* of the through-hole 60*b* is preferably set as in L1≤L2 in association with the circumferential dimension L1 of the stator outer peripheral surface region facing the third suction port 73. Thus, the suction-side pressure of the screw groove can be lower.

(2) The groove may be formed at the outer peripheral surface of the first screw stator 60 to form the gas paths 60G1, 60G2 as illustrated in FIGS. 8A and 8B, or the groove may be, as the gas path 700, formed at the inner peripheral surface of the first housing 70 provided to cover the outer peripheral side of the first screw stator 60 as illustrated in FIG. 3. Moreover, the gas path grooves may be formed at both of the outer peripheral surface of the first screw stator 60 and the inner peripheral surface of the first housing 70. This can increase the cross-sectional area of the gas path.

(3) As illustrated in FIGS. 3 and 4, the gas path 700 is preferably formed facing the entire opening area of the through-hole 60*a*. With such a configuration, the amount of gas flowing into each of the screw grooves GL3 to GL7 communicating with the through-hole 60*a* can be more uniform.

(4) In the mass spectrometer of the present embodiment, the second suction port 72 of the vacuum pump 1 is connected to the exhaust port 132 of the second intermediate chamber 114 in which the octopole 123 and the focus lens 124 as the first analysis unit are housed, and the third suction port 73 of the vacuum pump 1 is connected to the exhaust port 133 of the first intermediate chamber 113 in which the first ion lens 121 configured to operate in a higher pressure region than that of the first analysis unit is housed, as illustrated in, e.g., FIG. 11. Thus, exhaust from the plurality of chambers can be performed using the single vacuum pump 1, and as a result, a cost for the mass spectrometer 100 can be reduced.

As long as the features of the present invention are not incompatible with each other, the present invention is not limited to the above-described embodiments. For example, the vacuum pump provided with three suction ports has been described as an example in the embodiments, but the present invention is applicable to a vacuum pump including a first suction port 71 and a third suction port 73 without a second turbo-molecular pump stage TP2 and a second suction port 72.

Figure 12:
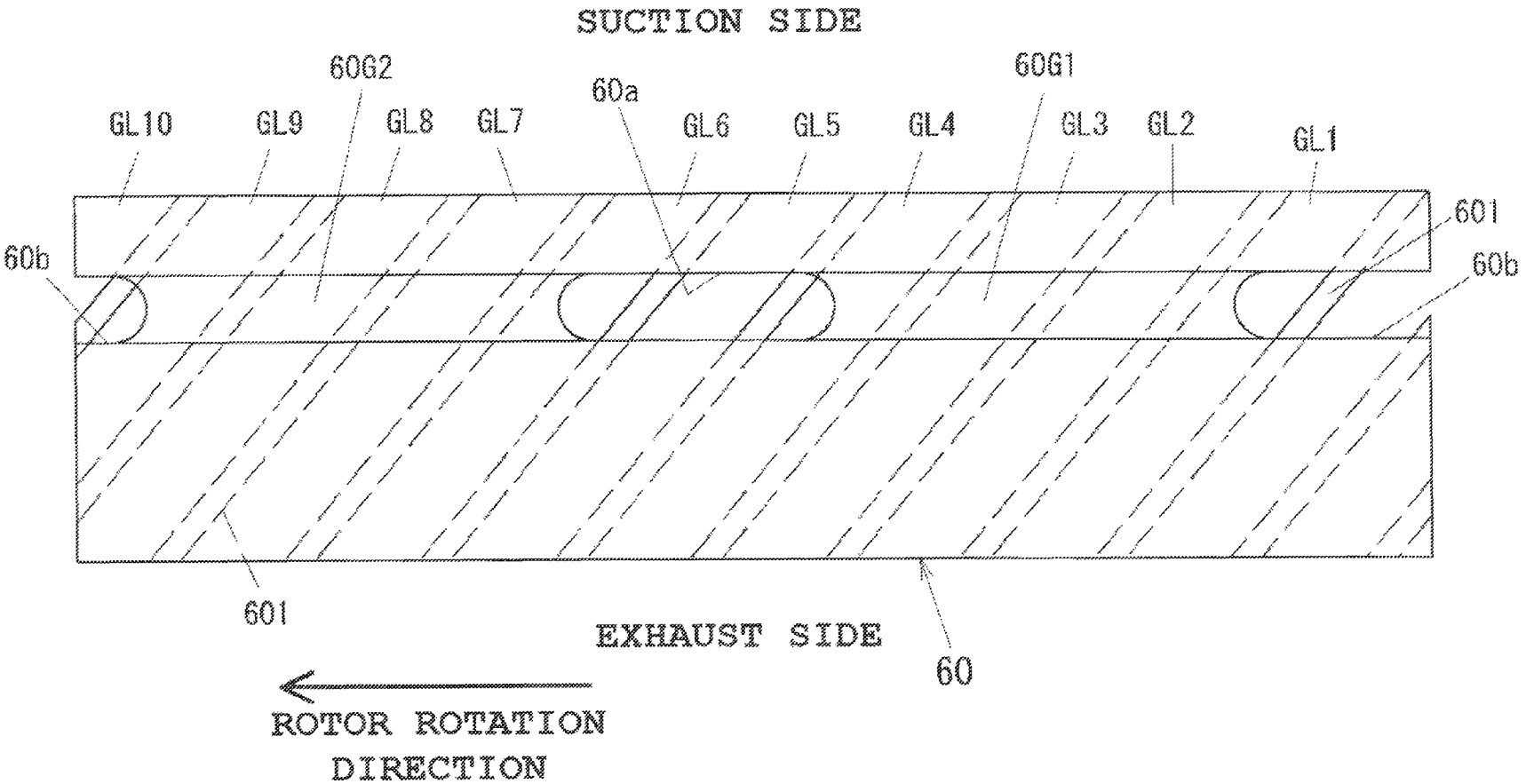
FIG. 12 is an exploded view of a first screw stator in the case where a through-hole does not penetrate through a screw thread.

In the above-described embodiments, each of the through-holes 60*a* to 60*c* is formed to penetrate through the screw threads 601. However, as illustrated in FIG. 12, each of the through-holes 60*a* to 60*c* may penetrate only through the screw grooves GL3 to GL7 with the screw threads 601 remaining unpenetrated.

What is claimed is:

1. A vacuum pump comprising:

a first pump stage;

a second pump stage provided on a pump downstream side of the first pump stage, and including a cylindrical stator configured such that a plurality of screw grooves and a plurality of screw threads are alternately formed in an inner peripheral surface circumferential direction, and a cylindrical rotor provided on an inner peripheral side of the cylindrical stator;

a first suction port provided on an upstream side of the first pump stage; and a second suction port provided on an downstream side of the first pump stage and communicating with the second pump stage, wherein one or more through-holes communicating with one or more of the plurality of screw grooves are formed at the cylindrical stator, a total of circumferential dimensions of the one or more through-holes formed at the cylindrical stator is set at equal to or greater than a circumferential dimension of an outer peripheral surface region of the cylindrical stator facing the second suction port, and a gas path through which inflow gas through the second suction port is guided to a screw groove is provided, the one or more through-holes penetrating through the screw groove and the screw groove being apart from the region facing the second suction port.

2. The vacuum pump according to claim 1, wherein the gas path includes at least one of a groove formed at an outer peripheral surface of the cylindrical stator or a groove formed at an inner peripheral surface of a pump housing provided to cover an outer peripheral side of the cylindrical stator.

3. The vacuum pump according to claim 1, wherein the gas path is formed facing an entire opening area of the one or more through-holes.

4. A mass spectrometer comprising:

the vacuum pump according to claim 1;

a first analysis unit;

a second analysis unit configured to operate in a higher pressure region than that of the first analysis unit;

a first chamber in which the first analysis unit is housed and which is provided with a first exhaust port connected to the first suction port of the vacuum pump; and a second chamber in which the second analysis unit is housed and which is provided with a second exhaust port connected to the second suction port of the vacuum pump.

* * * * *